US006338675B2

(12) United States Patent
Winkelman

(10) Patent No.: US 6,338,675 B2
(45) **Date of Patent: *Jan. 15, 2002**

(54) NAIL TECHNICIAN VENTILATION SYSTEM

(76) Inventor: Rebecca Winkelman, 9230 Old Highway 99 SE., Olympia, WA (US) 98506-9586

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/408,413

(22) Filed: Sep. 29, 1999

Related U.S. Application Data

(60) Provisional application No. 60/102,554, filed on Sep. 30, 1998.

(51) Int. Cl.[7] ..... B08B 15/02
(52) U.S. Cl. ..... 454/56; 55/385.2
(58) Field of Search ..... 454/56; 132/73, 132/73.5; 55/385.2, 473

(56) References Cited

U.S. PATENT DOCUMENTS

| | | | | |
|---|---|---|---|---|
| 1,977,386 A | | 10/1934 | Holes | |
| 3,121,618 A | | 2/1964 | Yerzley | 23/292 |
| 3,267,830 A | | 8/1966 | Van Gaasbeek | |
| 4,125,062 A | | 11/1978 | Eakes | |
| 4,249,463 A | | 2/1981 | Hornby | |
| 4,312,291 A | | 1/1982 | Knab | 118/50 |
| 4,505,190 A | * | 3/1985 | Fink et al. | 454/56 |
| 4,512,245 A | | 4/1985 | Goldman | |
| 4,553,992 A | | 11/1985 | Boissinot et al. | 55/279 |
| 4,647,295 A | | 3/1987 | Christ | 55/97 |
| 4,840,169 A | | 6/1989 | Folsom | 128/863 |
| 4,967,775 A | | 11/1990 | Kaiser | 132/73 |
| 5,063,834 A | | 11/1991 | Aalto et al. | |
| 5,112,373 A | | 5/1992 | Pham | 55/316 |
| 5,125,939 A | | 6/1992 | Karlsson | 55/316 |
| 5,181,883 A | | 1/1993 | Hofstra et al. | 454/49 |
| 5,316,560 A | | 5/1994 | Krone-Schmidt et al. | 55/385 |
| 5,336,128 A | | 8/1994 | Birdsong | 454/56 |

(List continued on next page.)

FOREIGN PATENT DOCUMENTS

| | | | | |
|---|---|---|---|---|
| FR | 343.296 | * | 9/1904 | 454/56 |

OTHER PUBLICATIONS

"Design Specifications for Glove Boxes" Moore & Hanks Co., Bulletin GB651–2M.
"NailVent2000", advertisement, Nov. 1998 (140) Nailpro (1 page).
"The Nail Safe Ventilator", advertisement, Nov. 1998 (126) Nailpro (1 page).

*Primary Examiner*—Harold Joyce
(74) *Attorney, Agent, or Firm*—R. Reams Goodloe, Jr.

(57) ABSTRACT

An environmental enclosure for nail technicians. The environmental enclosure includes a sec-through box constructed of acrylic plastic or other suitable optical quality material. An interior fan sweeps air into the enclosure and ejects contaminated air, including vapors and dusts, from the enclosure, to a suitable discharge point, via gas tight ductwork. A see-through sloping top is oriented downward toward the nail technician to eliminate glare and to assure that good optics are attained when viewing nails though the top of the enclosure. A preferably solid insert panel which includes hand passageways is detachably affixable to the front, for further restricting air-flow during desired operations. A plastic see-through air curtain is also detachably affixible to the front, for further restricting the flow of noxious gases and dusts. Additionally, a similar plastic see-through air curtain may be provided on the rear of the enclosure, to prevent noxious gases and dusts from escaping toward the client.

20 Claims, 6 Drawing Sheets

U.S. PATENT DOCUMENTS

| | | | | |
|---|---|---|---|---|
| 5,360,371 | A | 11/1994 | Bartimote | 454/56 |
| 5,464,029 | A | 11/1995 | Rentz | 132/73.5 |
| 5,487,768 | A | 1/1996 | Zytka et al. | 55/385.2 |
| 5,697,839 | A | 12/1997 | Chen et al. | 454/67 |
| 5,787,903 | A | 8/1998 | Blackshear | 132/73.5 |
| 5,795,219 | A | 8/1998 | Bloom | 454/49 |
| 5,816,906 | A | 10/1998 | Mai | 454/56 |
| 5,858,041 | A | 1/1999 | Luetkemeyer | 55/385.2 |

* cited by examiner 44
146
148
172
170
J1
174
H
S170-X
171
24
V
α

7
7
44
146
42
22
150
28
148
172
170
S170-X
171
S170-7
171
S170-5
S170-6
171
S170-4
S170-3
S170-2
S170-1
172

NAIL TECHNICIAN VENTILATION SYSTEM

This Application claims benefit to Provisional Application No. 60/102,554 filed Sep. 30, 1998.

TECHNICAL FIELD

This invention relates to devices for fume hoods, and more particularly, to an improved fume hood for use by a manicurist when polishing and applying finger nails.

BACKGROUND

Various attempts have been made over the years to provide useful and unique devices for protecting manicurists from fumes that evolve from the preparation and treatment of nails, and from the application of nail polish. Nevertheless, in various operations, particularly when the use of adhesives and solvents is required to properly prepare nails which conform in appearance to the visual requirements of clients, the environmental exposures of both the manicurist and the client are less than desirable. Indeed, some nail tech work environments are likely occasionally below those standards for airborne exposure limits to toxic materials as set by administrative agencies. In any event, it is clear that exposures to potentially harmful chemicals continues in the field, evidently primarily due to the apparent unavailability of cost effective environmental enclosures that would allow the nail technician to perform required work to produce finished nails of the desired aesthetic quality. Consequently, a continuing demand exists for a simple and inexpensive device to prevent the escape of toxic, noxious, and/or dangerous fumes during the normal operations conducted by nail technicians.

In general, I have found that currently available fume hoods which are known to me have limited adjustment and fume capture capability, and as result, fumes tend to escape through the openings of such devices. More particularly I have found that placement and orientation of air curtains and other devices meant to limit outward flow of contaminated air leaves much to be desired. Due to the restricted space available, and the slick, see-through, and often sharply angled surfaces which afford limited ability to permanently affix air curtains or other devices, there remains an ongoing need for a high visibility containment device to which air curtains and other removable and/or replaceable air flow limiting components can be affixed. Moreover, there remains an ongoing need for an environmental chamber that includes removable panels and air curtain devices that will readily attach to smooth optically acceptable containment surfaces, and which can be replaced on a regular basis as normal wear and tear take their toll on the apparatus. Finally, in some aspects it would be advantageous if the air flow restricting devices were adjustable, so that such the air flow restricting devices could be supported in a convenient, unobtrusive orientation.

SUMMARY

I have now invented, and disclose herein, a novel, unique, adjustable air curtain attachment device for use with an optically neutral (near window quality) visual quality environmental enclosure. Preferably, to enhance the visual accuracy, the enclosure includes a see-through panel downwardly sloping from the client (or rear side) toward the nail technician (or front side) in a manner where the eyes of the nail technician can look directly through, at a relatively direct angle, toward the nails on which work is being performed. Also, it is preferable that the top of the enclosure be sufficiently low so that the nail technician can still make direct eye contact, over the enclosure, with the client.

Detachable air curtains are provided which are especially effective for temporary attachment to smooth interior and/or exterior surfaces of the environmental enclosure. Most preferably, the device reliably and effectively provides for negative pressure at inlet openings by utilizing an air discharge fan, to draw air into the enclosure and to positively discharge contaminated air outward from the enclosure.

In one embodiment, my novel environmental enclosure for nail technicians has an open bottom, and can be simply set on, or alternately is detachably affixable to, a pre-selected substrate such as a desk, table, or other suitable surface. Generally, the enclosure is adapted for removal from such substrate to facilitate easy cleanup of both the enclosure and of the substrate after work on each individual client is completed.

In summary, my environmental enclosure for nail technicians provides a unique, simple to manufacture, and easy to use environmental enclosure device that improves the ability of the nail technician to see the nails on which work is being performed. Importantly, my environmental enclosure minimizes the escape of noxious and toxic substances, compared to various prior art environmental enclosures for nail technicians.

OBJECT, ADVANTAGES, AND NOVEL FEATURES

From the foregoing, it will be apparent to the reader that one important and primary object of the present invention resides in the provision of a novel environmental enclosure for nail technicians in which air flow reducing enhancements (such as see-through panels and air curtains) are easily attached. My novel apparatus effectively and detachably secures a panel having pathways for the hands of nail technician to pass therethrough, while effectively limiting and substantially preventing the outward escape of noxious and toxic gases. Also, and alternately in conjunction with a detachable panel, a detachable air curtain, preferably of thin, see-through plastic sheet portions, further hinders the escape of noxious and/or toxic fumes from the enclosure.

One important object of the invention is to allow downward adjustment of the size of the opening on the nail technician side to enable improved or enhanced protection when particularly noxious substances are present within the enclosure.

It is an advantage of my environmental enclosure that the opening passageway can be reconfigured as desired on the nail technician side, from a large opening, to an "air-curtain" opening, to a solid panel with only hand openings, or to a solid panel with hand openings in conjunction with use of a see-through air-curtain, so that the desired degree of engineering controls employed can be adjusted consistent with the degree of hazard, depending upon the operation being performed on nails at any particular time.

It is a feature of my environmental enclosure that a relatively flat panel is arranged at an angle to faces the eyes of the nail technician, so that the nail technician can look directly down on the nails on which operations are being performed, without optical distortion, less than adequate lighting, or perspective problems.

One design objective of my environmental enclosure is to provide flexibility of use in a desirable location, by providing the necessary parts for connection of an exhaust fan on either side of the enclosure.

It is a feature of one embodiment of the present invention that an exhaust fan can be provided on either side, since a fan exhaust aperture cover is provided in a form susceptible for switching to either side of the enclosure, yet uses the same attachment hardware as is necessary to affix an exhaust fan to the device.

Another object my invention is to provide an easy to use environmental enclosure. This is important, but seemingly overlooked heretofore, since nail technicians frequently need to quickly retrieve a tool or bottle while avoiding the possibility of creating noxious vapors outside of the enclosure.

It is another objective of my invention to eliminate the need for nail technicians to utilize protective safety glasses when performing operations on nails. It is an important advantage of my invention that the use of safety glasses by a nail technician can be eliminated when utilizing my environmental enclosure, since all operations are performed behind a clear protective wall that remains between a nail technician's eyes and nails on which operations are being performed.

It is a feature that the environmental enclosures disclosed and described herein are adaptable for reliable use throughout a range of angles and orientations, with a minimum of user manipulation to assure that the unique advantages of the enclosure are achieved.

Yet another design objective is flexibility of location and placement of the environmental enclosure. It is an important feature of my invention that the environmental enclosure is adaptable for attachment to a variety of surfaces, and particularly smooth surfaces such as existing desks and tables, and can be adjusted for efficient operation at any such pre-selected location. In this manner, my novel environmental enclosure may be used in a wide variety of locations, eliminating the necessity for the use to purchase a complete "work-station" for manicurists, as has often been the case heretofore.

In conjunction with the preceding object, another important and useful objective of my design is portability. It is an advantage of my invention that the environmental enclosure is light in weight, and can be easily removed by adult females from a desired operation location such as a nail technician's home or shop, and carried for placement in a transport vehicle, and easily transported to a new location for re-installation and continued use. This is particularly important in environments where the use of such devices is up to nail technicians, rather than being furnished as a part of the fixed equipment for use by a facility when the nail technician arrives. Thus, it is an important advantage and novel feature that my apparatus is designed with relatively lightweight materials.

Other important and more specific objects, advantages, and novel features of the invention will become apparent to the reader from the foregoing and from the appended claims, as well as the ensuing detailed description and discussion which proceeds in conjunction with the accompanying drawing.

DETAILED DESCRIPTION

Figure 1:
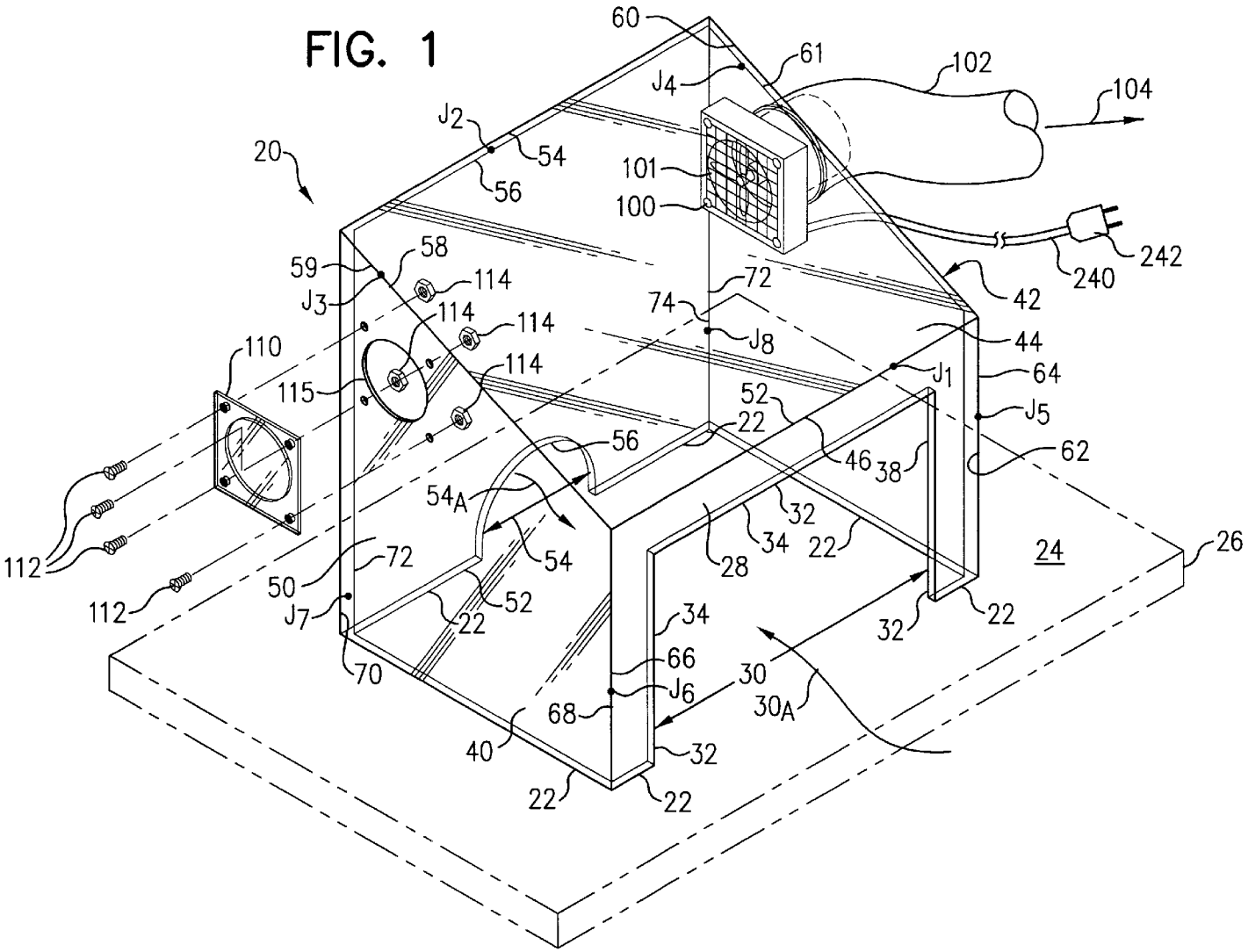
FIG. 1 is a front perspective view of my environmental enclosure for a nail technician, illustrating a front, relatively large, and preferably rectangular opening for use by the nail technician, and a narrow opening so that a single hand of a client can be placed therethrough during nail care operations; also shown are dual fan outlet apertures so that a single exhaust fan may be placed on the desired side of the enclosure and a cover plate placed over the fan outlet aperture on the unused side.

As seen in FIG. 1, I have developed a novel and useful see-through protective environmental enclosure 20 for nail technicians. The enclosure 20 has a lower surface footprint portion 22 that can be placed in substantially sealing fashion against a suitable substrate such as the top 24 of desk 26. The enclosure has a front or nail technician panel 28 in which a substantial sized opening 30 is provided as defined by sidewall 32. Preferably, the opening 30 is "three-sided" so that there is not footprint portion 22 below such opening 30 in the environmental enclosure 20. More preferably, the opening 30 is parallelepiped in shape, and most preferably, substantially rectangular, so that the sidewall 32 defining the opening includes a left side wall 34, a top wall 36, and a right side wall 38, resulting overall in a front panel 28 that is generally in an upside down U-shape.

Figure 4:
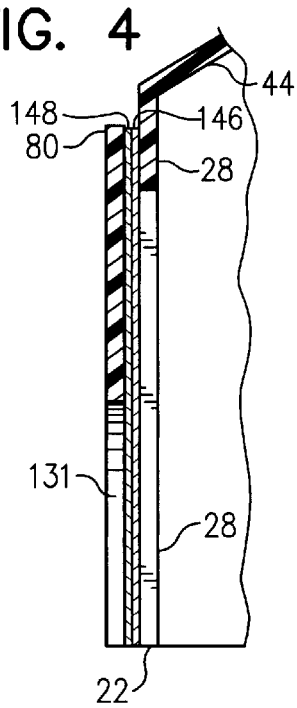
FIG. 4 is a vertical cross-sectional view, taken through line 4—4 of FIG. 3, showing the detachably affixable solid insert, which has hand passageways for the nail technician, being held in place by a perimeter strip of hook and loop type fastener, portions of which have been adhesively affixed to the outer wall of the front of the environmental enclosure, and to the inner surface of the insert, respectively, to be joined in an easily detachable yet affixed fashion.

Opposing sidewalls are provided, namely first or left side panel 40 and second or right side panel 42. Preferably, first and second side panels 40 and 42 are generally trapezoidal in shape, or perhaps trapezium in shape, so as to support a preferably flat top panel 44 which slopes downwardly (at an angle alpha ($\alpha$) as seen in FIG. 4 below) toward the upper end 46 of front panel 28. This orientation is important, because a flat, optically clear, downwardly sloping top panel 44 allows a nail technician to clearly see the nails on which work is to be performed, without optical distortion or depth perception problems, while still avoiding contact with noxious vapors and dusts. Preferably, each of the panels of the environmental enclosure, including front panel 28, first side 40 and second side 42, and rear panel 50, and especially sloping top panel 44, are provided in see-thru material of reasonably good optical quality, such as plexiglass or acrylic plastic.

A rear or client side panel 50 is normally substantially rectangular in shape, having along the bottom 52 a centrally located "rat-hole" most desirably in a low archway shaped opening 54 defined by sidewall 56 that is sized to allow a single hand of a client to be placed therethrough.

I like to constrict my environmental enclosure to seal, in a substantially gas-tight fashion, the joints J between various panels, including:

- the joint J1 between the top 46 of front panel 28 and the front 52 of top panel 44;
- the joint J2 between the rear 54 of top panel 44 and the top 56 of the rear panel 50;
- the joint J3 between the left side 58 of top panel 44 and the top 59 of left side panel 40;
- the joint J4 between the right side 60 of top panel 44 and top 61 of right side panel 42;
- the joint J5 between right side 62 of front panel 28 and front 64 of right side panel 42;
- the joint J6 between left side 66 of front panel 28 and the front 68 of left side panel 40;
- the joint J7 between the rear 70 of left side panel 40 and the left 72 of rear panel 50; and
- the joint J8 between the rear 72 of right side panel 42 and the right 74 of rear panel 50.

These joints can be configured in any desired detailed configuration sufficient to structurally hold the environmental enclosure 20 together when the various joints J1 through J8 just described are tightly joined, preferably by permanent glue joint or other convenient molding or finishing technique, ideally in a substantially gas tight configuration.

By sealing the various panels together as just explained, then the escape of noxious or toxic is substantially eliminated, and the rate of influx of sweep air can be substantially controlled by the regulation of the size of the opening 30, whether provided as shown in FIG. 1, or with further air-flow restrictions via use of solid panel 80 or air curtains 90 or 96 as further explained hereinbelow. In any event, I prefer that ventilation be provided by positive means, such as via a fan 100 preferably but not necessarily located within or adjacent the upper reaches of the environmental enclosure 20. I have found that a fan manufactured by the Dayton Electric Company, of Niles, Ill. U.S.A., Dayton Model 4C549A, with 100 cubic feet per minute while quietly running at 2150 revolutions per minute and consuming 15.2 watts of power, is quite effective for a fan 100 mounted within the enclosure 20. Such a fan pulls air in through the client opening 54 (in the direction of reference arrow $\mathbf{54}_A$), and through the nail technician opening 30 (in the direction of reference arrow $\mathbf{30}_A$), to sweep noxious gases and dusts upward through screen 101 and on through the fan 100 and thence is exhausted outward, away from either the nail technician or the client. Discharge is out through discharge vent piping 102 to any convenient location, in the direction of arrow 104. In this regard, note in FIG. 10 that in some locations it may be desirable to route vent piping 102 through an indoor situated high efficiency filter 106 suitable for capture of noxious gases and particulates encountered so that air may be discharged from local filter box 108 via outlets 109 directly into the building interior as indicated by reference arrow $\mathbf{109}_A$.

Figure 2:
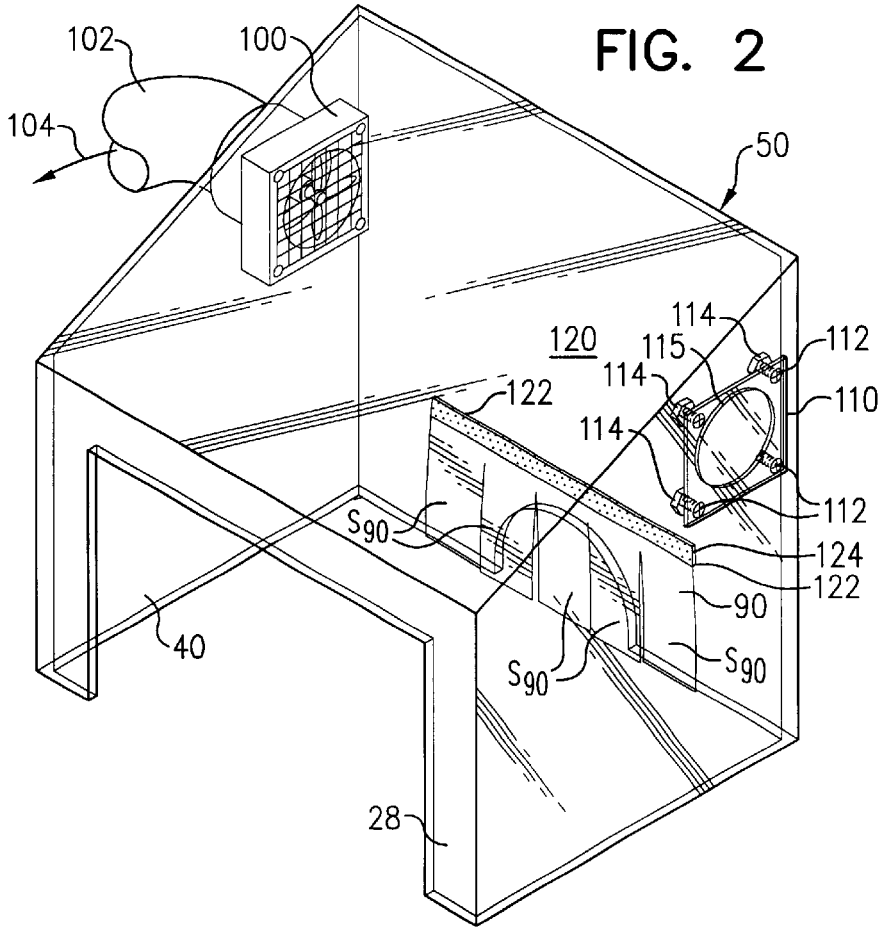
FIG. 2 is also a front perspective view of my environmental enclosure for a nail technician, similar to the view just illustrated in FIG. 1, also illustrating the front, relatively large, and preferably rectangular opening for use by the nail technician and an opposing narrow, preferably arch-like narrow rear opening used to receive a single hand of a client, with an air-curtain of see-through plastic strips to reduce the potential for escape of air toward the client; also shown is the single exhaust fan on the left side of the enclosure, rather than on the right side as illustrated in FIG. 1 above, and with a cover plate placed on the unused right side fan outlet aperture.

Fan 100 can be located on the right side of enclosure 20 as shown in FIG. 1, or on the left side of enclosure 20, as shown in FIG. 2, or if desired, in another convenient location. In the some preferred cases which are illustrated herein, a cover plate 110 is provided for secure mounting, such as via fastener system of threaded screws, or bolts 112 and nuts 114, over the unused fan outlet aperture 115 on the unused side panel, whether it is left side panel 40 as shown in FIG. 1, or the right side panel 42 as shown in FIG. 2.

Figure 10:
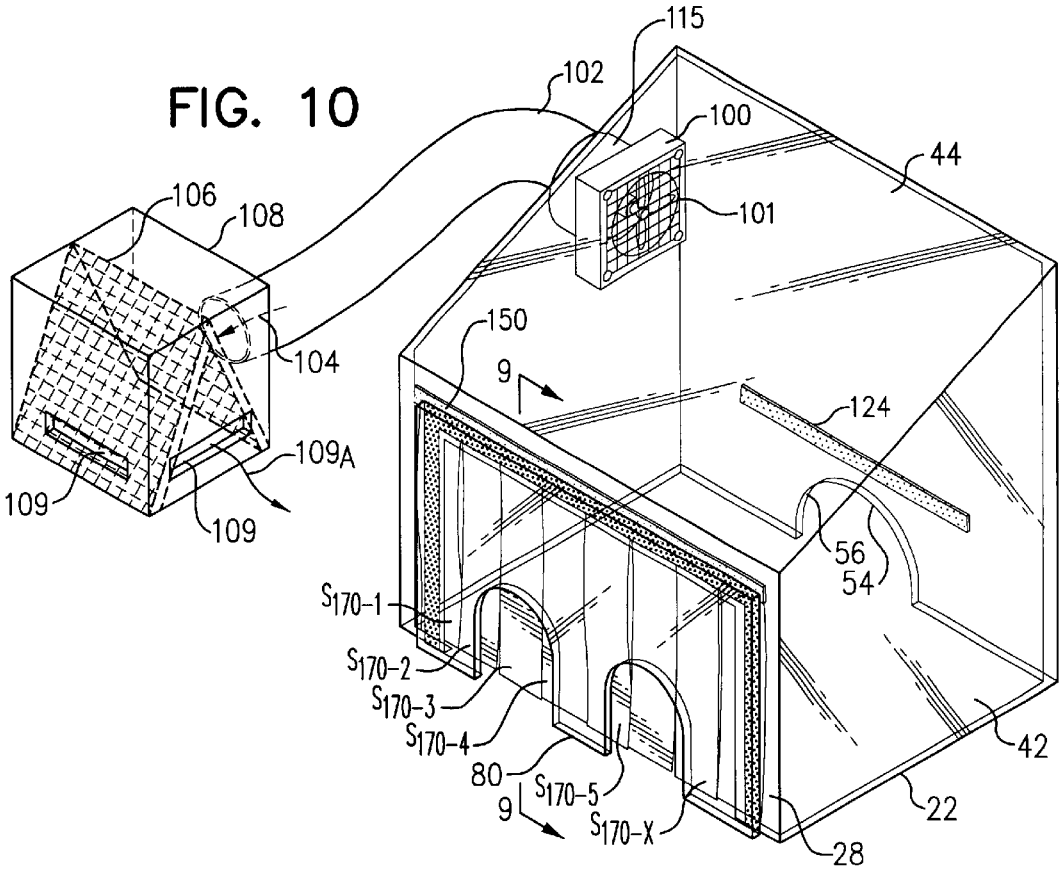
FIG. 10 is a perspective view of my environmental enclosure, showing in operative position both the solid insert panel and the air curtain devices as illustrated in more detail in the previous figures, as well as illustrating an embodiment wherein one side wall is provided with a fan outlet aperture leading to a filtering unit and interior space air outlet box.

Turning now to FIG. 2, an interior air-curtain 90 is shown detachably affixed to the interior 120 of rear panel 50, via mating sections of hook 122 and loop 124 type fastener, such as Velcro® brand fastening tape. It is not necessary to always use air-curtain 90, and it can be detached as illustrated in FIG. 10, leaving behind a first side, whether hook 122 or loop 124 of the hook and loop fastening strips. As illustrated, air-curtain 90 includes a plurality of strips $S_{90}$ affixed to a common header such as a width of loop fastener 122 of desired length.

Figure 3:
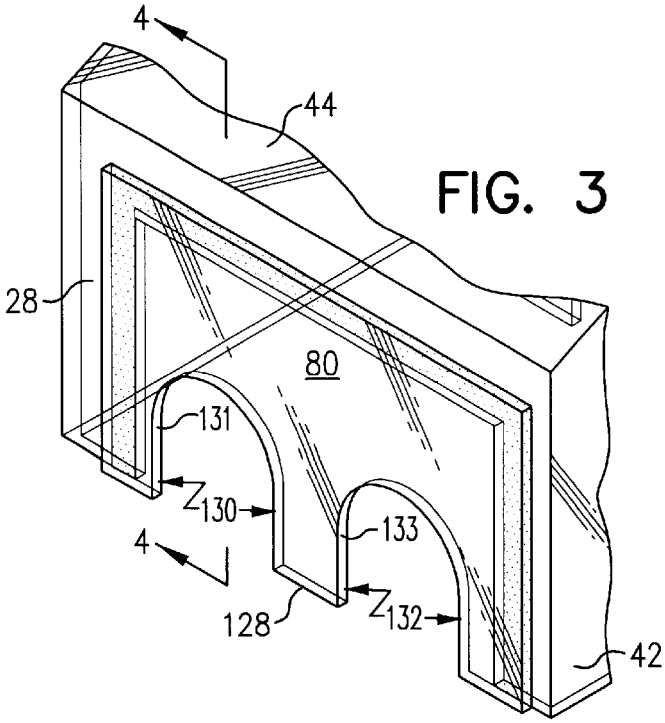
FIG. 3 is a partial front view, showing a preferably rigid, solid insert for attachment to the front of the enclosure via selected fasteners such as Velcro brand hook and loop strips that are affixed in opposing fashion to the front of the enclosure and to the rear of the insert, for limiting size (number of square inches) of the air passageway available on the nail technician (or front) side of my environmental enclosure.
Figure 5:
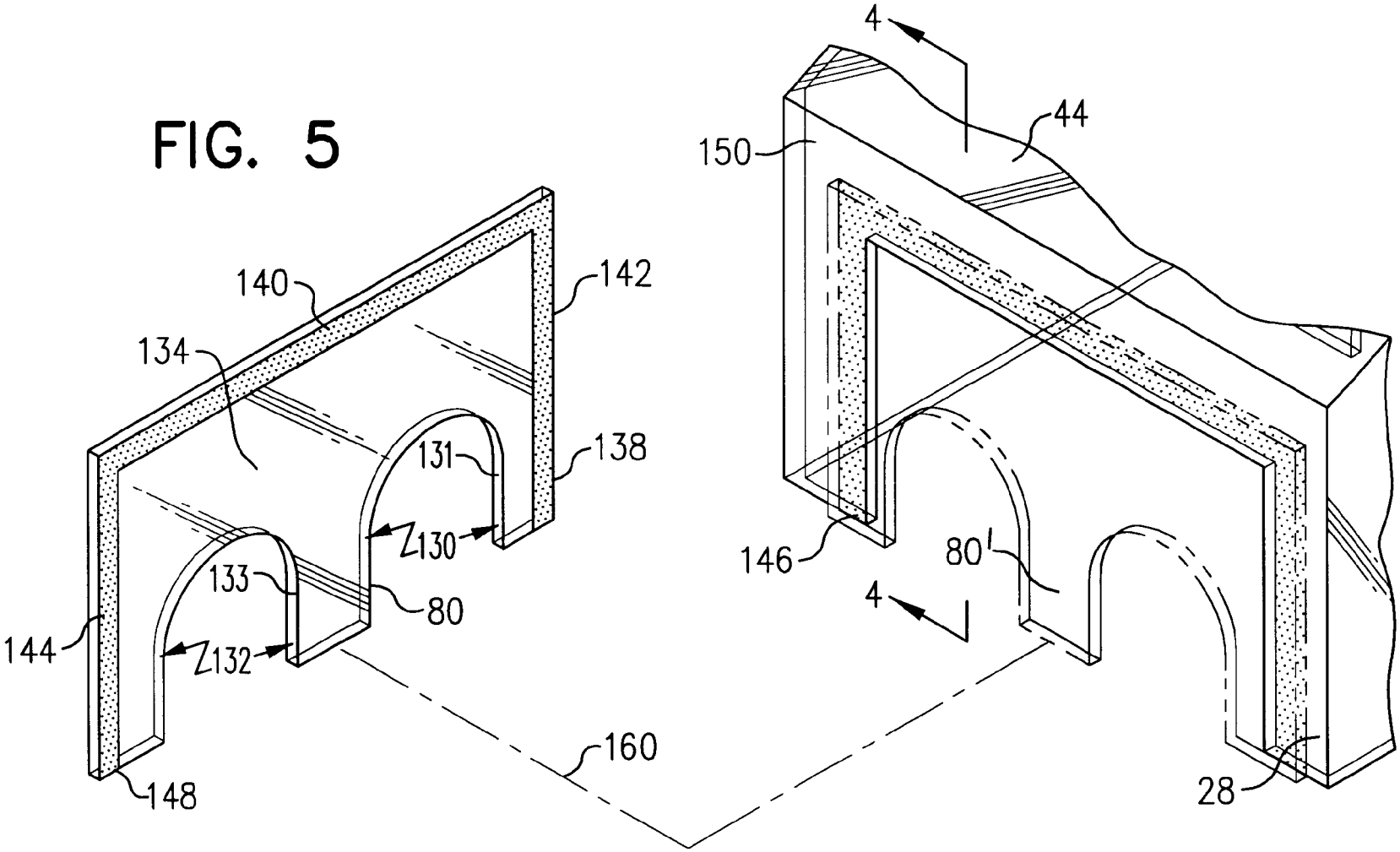
FIG. 5 is an exploded partial perspective view showing how the solid insert first illustrated shown in FIG. 3 above is detached from the front of the environmental enclosure.

Most preferably my environmental enclosure is provided with a front detachable insert panel 80 as seen in FIG. 3. Insert panel 80 includes, along the lower reaches 128 thereof, first 130 and second 132 hand insert cutouts defined by cutout edgewalls 131 and 133, respectively, and which insert cutouts 130 and 132 are sized and shaped for insertion of the left and right hands of a nail technician therethrough. Most preferably, first 130 and second 132 hand insert cutouts are archway shaped. As may be better seen in FIG. 5, The rear or inner surface 134 of insert panel 80 includes a rear perimeter, 138, and around the top 140, left 142, and right 144 edges of the rear perimeter, selected complementary fastener system components such as Velcro brand loop 148 (or alternately, hook 146) strips are affixed, with the complimentary material affixed in opposing fashion to the outer wall or front 150 of front panel 28 of the enclosure 20. When the insert panel 80 is affixed to the front panel 28 of enclosure 20 in the just described manner (see FIG. 5, for the installation, where the installed position of insert panel 80 is indicated in hidden lines and tagged with reference numeral 80'), then the available air passageway size (e.g., the net size as measured by the number of square inches of the passageway) on the nail technician's side of the enclosure 20 is significantly reduced, thus reducing the possibility of escape of noxious or toxic fumes, and diminishing the chance that such undesirable fumes reach the nail technician.

Turning now to FIG. 4, the features just discussed with reference to FIG. 3 are further illustrated in a vertical cross-sectional view taken through line 4—4 of FIG. 3. In FIG. 4, the showing the detachably affixable solid insert panel 80 is seen being held in place by a perimeter strip of hook 146 and loop 148 type fastener, portions of which have been adhesively affixed to the outer wall 150 of the front 28 of the environmental enclosure 20, and to the rear or inner surface 134 of the insert 80, respectively, to be joined in an easily detachable yet affixed fashion. These detailed features are further clarified in phantom lines seen in FIG. 5, where the preferably solid and "see-through" insert panel 80 is shown "in-place" in hidden lines with reference numeral 80'. In this FIG. 5, the replaceable/detachable feature is illustrated by reference line 160, which shows how the insert 80 is removed to allow cleaning of the interior of the environmental enclosure 20. The same mechanism is also illustrated in FIG. 8 below, using reference lines 162 and 164, but in that figure, the "in-place" or operating location of insert panel 80 is not illustrated.

Figure 6:
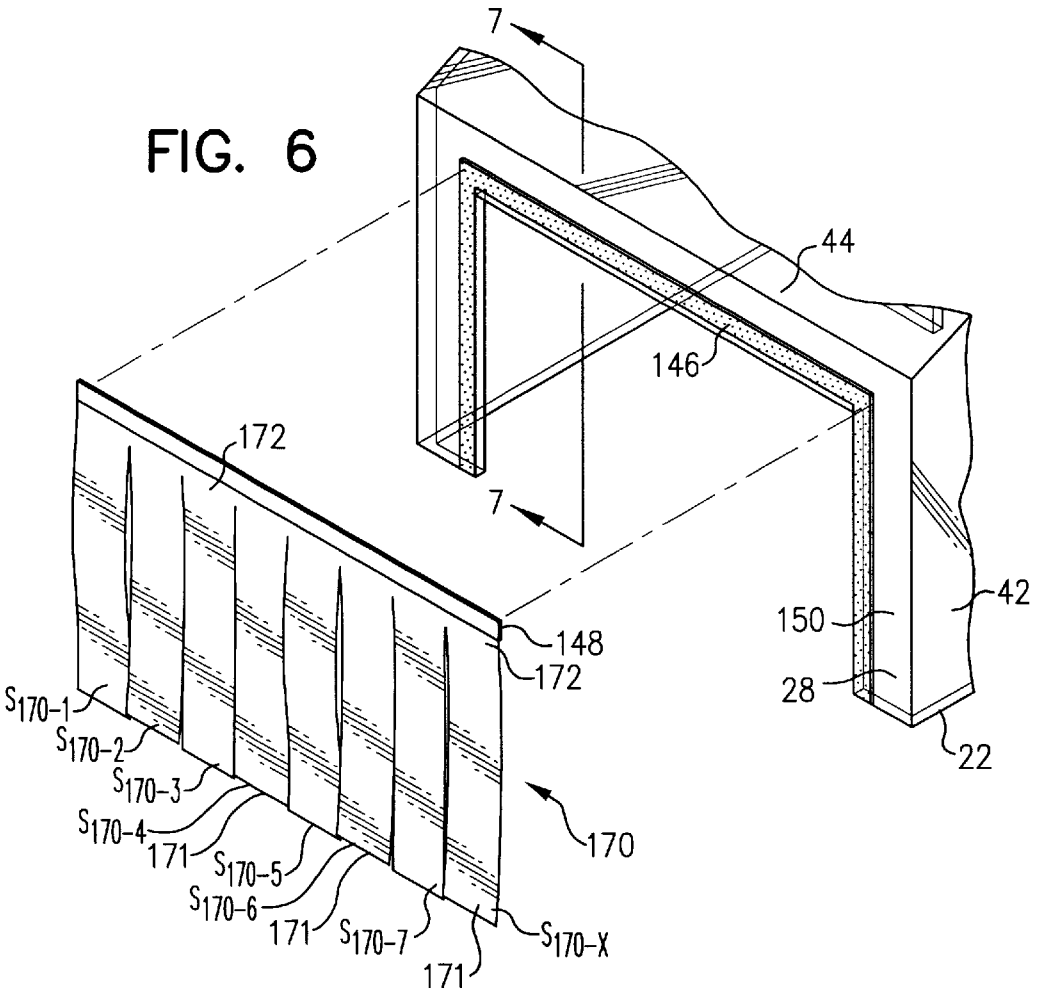
FIG. 6 illustrates a detachable see-through plastic air curtain, here shown affixed to the outer wall of the front of the environmental enclosure.

In FIG. 6 another embodiment of my environmental enclosure is illustrated. Here, a detachable see-through plastic air curtain 170 is shown affixed to the outer wall 150 of the front panel 28 of the environmental enclosure 20. Plastic air-curtain is preferably made of optically acceptable plastic, of about 4 mil thickness. The air curtain includes a plurality of suspended, downwardly hanging, abutting sections $S_{170\text{-}1}$ through $S_{170\text{-}x}$ in a series from 1 to X where X is a positive integer equal to the number of sections in air curtain 170. The sections $S_{170\text{-}X}$ are each attached to and ideally hang down from an elongate header portion 172 far enough to touch at the bottom 171 of the sections a selected substrate 24 provided therebelow (see FIGS. 1 or 7), so as to minimize passage therethrough of noxious or toxic fumes and dusts. Along header 172 of air-curtain 170 is provided a section of loop 148 type fastener, portions of which are preferably adhesively attached, and which are suitable for joining in complementary fashion a section of hook 146 fastener that is preferably adhesively affixed to the outer wall 150 of the front 28 of the environmental enclosure 20. In this manner, air-curtain may be joined to front 28 in an easily detachable yet affixed fashion.

Figure 7:
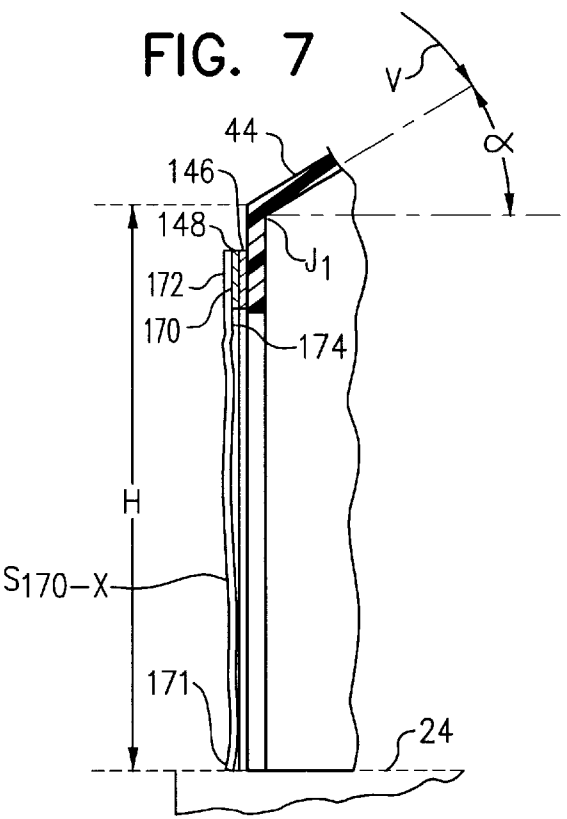
FIG. 7 shows a vertical cross-sectional view, taken through line 7—7 of FIG. 6, showing a detachably affixable plastic air curtain being held in place by a top strip of hook and loop type fastener, portions of which have been adhesively affixed to the outer wall of the front of the environmental enclosure, and to the inner surface of the top of the air-curtain panel, to be joined in a detachably affixed fashion.

FIG. 7 shows a vertical cross-sectional view, taken through line 7—7 of FIG. 6, showing the detachably affixable plastic air curtain 170 being held in place by complementary top strips of hook 146 and loop 148 type fastener, portions of which have been adhesively affixed to the outer wall 150 of the front 28 of the environmental enclosure 20, and to the inner surface 174 of the header 172 of the air-curtain panel. Also shown in FIG. 7 is the angle alpha ($\alpha$) that the top panel 44 is raised above the horizontal plane, so that the top panel 44 slopes downward toward the front 28 or nail technician side of my environmental enclosure 20. I prefer to use an angle alpha ($\alpha$) of about 30 degrees, or perhaps slightly more, so that a good visual field is provided to the manicurist as indicated by reference arrow V for directly viewing the substrate 24 on which a client's hands bearing the nails being examined are resting. Also, a vertical height H for the front panel 28 of about 12 inches is preferred, so provide sufficient room for the nail technician to work, but to still keep the top 44 sufficiently low at the joint J1 so that a nail technician can easily see over the joint J1 and directly through top 44 to the nails being examined. As can be seen in FIG. 1, ideally joint J2 is not so high that eye contact with the client is lost by the nail technician.

Figure 8:
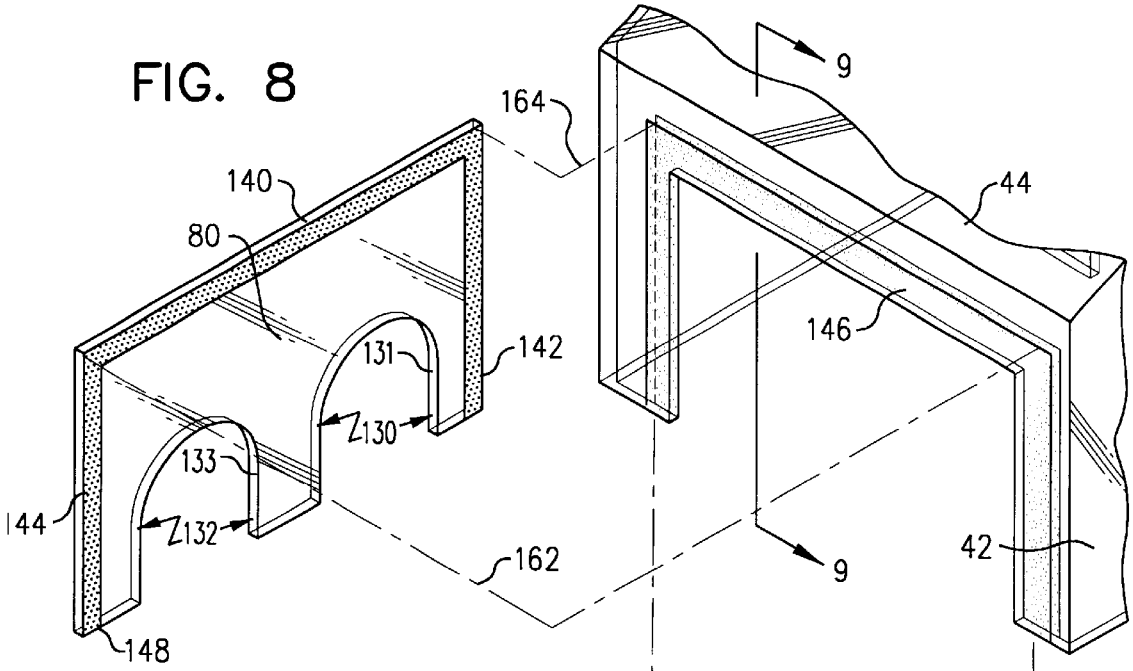
FIG. 8 illustrates the simultaneous use of both the solid insert panel and the plastic air curtain, as depicted in FIGS. 5 with respect to the solid insert, but now using the air curtain affixed to the inner wall of the front of the environmental enclosure.
Figure 9:
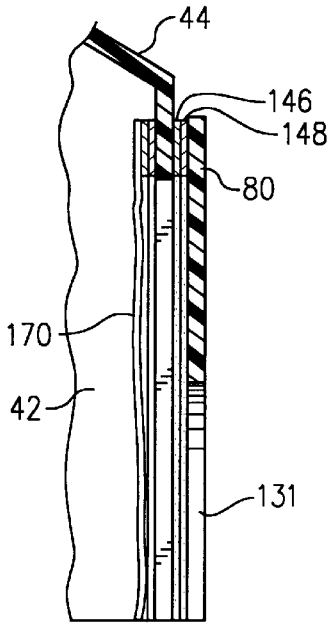
FIG. 9 shows a vertical cross-sectional view, taken through line 9—9 of FIG. 8, showing a) the detachably affixable plastic air curtain being held in place by a top strip of hook and loop type fastener, portions of which have been adhesively affixed to the inner wall of the front of the environmental enclosure, and to the top of the air curtain, and (b) the solid insert, which is joined in a detachably affixed fashion to the outer front wall of the environmental enclosure, being held in place by a perimeter strip of hook and loop type fastener, portions of which have been adhesively affixed to outer wall of the front of the environmental enclosure, and to the rear surface of the solid insert, respectively.
Figure 9:
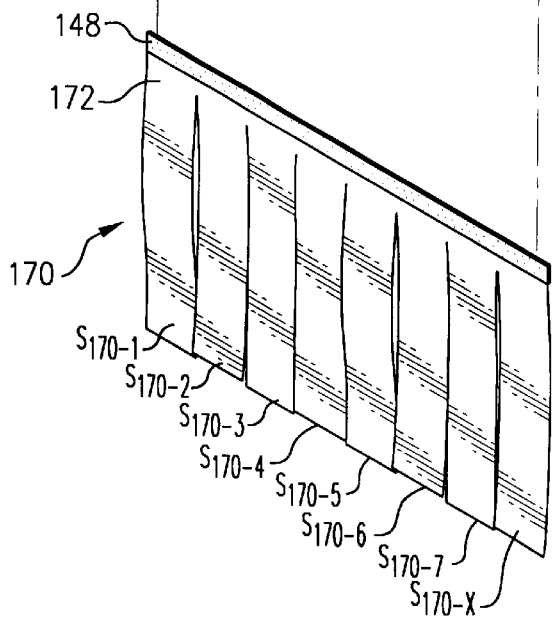

Again, FIG. 8 illustrates the simultaneous use of both the solid insert panel 80 and the plastic air curtain 170 at the front 28 of the environmental enclosure 20. The installed configuration is confirmed in FIG. 9, which shows a vertical cross-sectional view taken through line 9—9 of FIG. 8. Here, the detachably affixable plastic air curtain 170 is affixed on the inner wall 180 of front panel 28. As earlier described, air-curtain 170 is held in place by a top strip of hook 146 and loop 148 type fastener, portions of which have been adhesively affixed to the inner wall 180 of the front 28 of the environmental enclosure 20, and portions of which have been adhesively affixed to the inner side 174 of the header 172 of the air curtain 170.

A preferred working configuration of my environmental enclosure 20 is illustrated in FIG. 10, which provides a perspective view showing in operative position both the solid insert panel 80 and the air curtain 170 as illustrated in more detail in the previous figures. Also, this FIG. 10 shows an embodiment wherein only the first side panel 40 is provided with a fan outlet aperture 115. Alternately, the second side panel 42 could be provided with a fan outlet aperture 115, and in either case, the opposing panel does not contain an unneeded penetration that must be covered with cover plate 10, as evident in FIG. 1.

Figure 11:
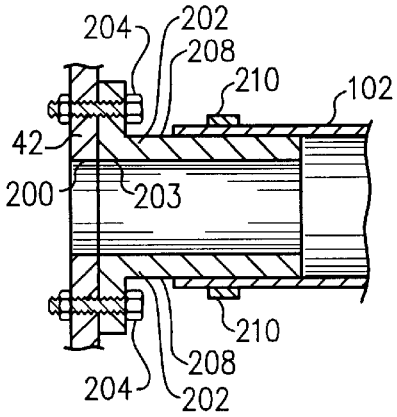
FIG. 11 is a cross-sectional detail of another embodiment of my fan outlet aperture, showing the use of an external T joined with fasteners to a sidewall panel adjacent a fan outlet aperture, with a flexible outlet tube secured via a hoop type clamp.

Finally, I have found that various fan outlets may be provided as needed for a desired location and configuration. In FIG. 11, a cross-sectional detail of another embodiment of my fan outlet aperture 200 is shown, illustrating the use of an external "tee" 202 with smooth cylindrical internal bore 203. The "tee" 202 is affixed with fasteners 204 (such as bolts and complementary nuts) to a sidewall panel such as panel 42. Then, outlet tubing 102 is provided sized and shaped for close fitting engagement with the external tubular sidewall 208 of the T 202. A hoop type clamp 210 secures the outlet tubing 201 to the "tee" 202.

Figure 12:
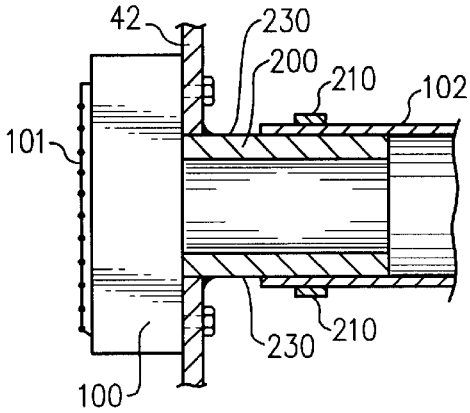
FIG. 12 is a cross-sectional detail of another embodiment of my fan outlet aperture, showing use of tight-fitting pipe section inserted into the fan outlet aperture, and sealed in an air-tight fashion to the sidewall panel, with a flexible outlet tube secured via a hoop type clamp.

Yet another embodiment is illustrated in FIG. 12, where a tight fitting pipe section 220 is inserted into the fan outlet aperture 202, preferably in a flush relationship with inside wall 222 of sidewall 42, and then sealed in an air-tight fashion (such as with glue 224). The flexible outlet tube 102 in this embodiment is also preferably secured via a hoop type clamp 210 acting on the outer cylindrical surface 230 of pipe section 220.

As indicated in FIG. 1 above, the fan 100 is preferably externally powered, in which case an external power cord 240 is included with plug 242.

It will thus be seen that the objects set forth above, including those made apparent from the preceding description, are efficiently attained. Since certain changes may be made in carrying out the construction of an environmental enclosure according to the teachings herein, it is to be understood that my invention may be embodied in other specific forms without departing from the spirit or essential characteristics thereof. Many other embodiments are also feasible to attain advantageous results utilizing the principles disclosed herein. Therefore, it will be understood that the foregoing description of representative embodiments of the invention have been presented only for purposes of illustration and for providing an understanding of the invention, and it is not intended to be exhaustive or restrictive, or to limit the invention only to the precise forms disclosed.

All of the features disclosed in this specification (including any accompanying claims, the various figures of the drawing) may be combined in any combination, except combinations where at least some of the features are mutually exclusive. Each feature disclosed in this specification (including any accompanying claims, and the various figures of the drawing), may be replaced by alternative features serving the same or similar purpose, unless expressly stated otherwise. Thus, each feature disclosed is intended to be one example of a generic series of equivalent or similar features. Further, while certain materials are described for the purpose of enabling the reader to make and use certain embodiments shown, such suggestions shall not serve in any way to limit the claims to the materials disclosed, and it is to be understood that other materials, including other metals and various plastic compositions, may be utilized in the manufacture of my novel environmental enclosures.

The intention is to cover all modifications, equivalents, and alternatives falling within the scope and spirit of the invention, as expressed herein above and in the appended claims. As such, the claims are intended to cover the strictures, apparatus, and methods described herein, and not only the equivalents or structural equivalents thereof, but also equivalent structures or methods. The scope of the invention, as described herein and as indicated by the appended claims, is thus intended to include variations from the embodiments provided which are nevertheless described by the broad meaning and range properly afforded to the language of the claims, as explained by and in light of the terms included herein, or the equivalents thereof.

I claim:

1. An environmental enclosure for nail care technicians, said enclosure comprising:

(a) a front wall, said front wall comprising an interior sidewall defining an air-flow restrictive front opening, said front wall further comprising a solid see-through attachment portion detachably affixable to said front wall and adapted to further restrict the flow of air through said front opening, said solid see-through attachment portion further comprising at least one hand sized passageway therethrough;

(b) a pair of opposing side-wall portions;

(c) a rear wall, said rear wall comprising at least one opening at the lower reaches thereof;

(d) a see-through, optically reliable top, said top further comprising at least one planar portion oriented to slope downwardly toward said front wall.

2. The environmental enclosure as set forth in claim 1, wherein said front opening further comprises a see-through air-curtain portion detachably affixable to said front wall, said see-through air-curtain adapted to further restrict the flow of air through said front opening.

3. The environmental enclosure as set forth in claim 2, wherein (a) said solid, see-through attachment portion further comprises a perimeter area, said perimeter area having affixed thereto a strip of hook and loop fastener, and (b) said front wall further comprises an outer wall portion, said outer wall portion further comprising a strip of hook and loop fastener affixed thereto, said hook and loop fastener generally complimentary in configuration and location to that provided on said attachment portion, (c) said solid see-through attachment portion detachably affixable to said front wall.

4. The environmental enclosure as set forth in claim 1, wherein said planar portion of said top slopes downwardly toward said front wall, with reference to a horizontal line, at an angle alpha.

5. The environmental enclosure as set forth in claim 4, wherein said angle alpha is approximately 30 degrees.

6. The environmental enclosure as set forth in claim 2, wherein said environmental enclosure is suitable for location on a pre-selected substrate, and wherein see-through air-curtain portion further comprises:

(a) a plurality X of curtain sections $S_X$ in a series from 1 to X, wherein X is a positive integer, and (b) each curtain section of said plurality of curtain sections (i) sized and shaped to seal one against the other, laterally, and (ii) extend downward to a lower edge portion, said lower edge portion sized and shaped to substantially seal against said pre-selected substrate.

7. The environmental enclosure as set forth in claim 1, wherein said rear wall further comprises a detachably affixable rear air curtain portion, said detachable affixable rear air curtain portion sized and shaped to substantially seal said opening at the lower reaches of said rear wall to prevent the outward migration of noxious vapors and dusts therethrough.

8. The environmental enclosure as set forth in claim 1, wherein said opening in said rear wall comprises a small, arcuate, rat-hole shaped opening.

9. The environmental enclosure as set forth in claim 1, further comprising an exhaust fan, said exhaust fan mounted with said environmental enclosure and adapted to pull sweep air into said enclosure and to eject contaminated air therefrom.

10. The environmental enclosure as set forth in claim 9, further comprising, mounted in fluid communication with said exhaust fan, a length of discharge vent piping, said vent piping suitable for routing noxious dusts and vapors away from said environmental enclosure.

11. The environmental enclosure as set forth in claim 10, further comprising, in fluid communication with the distal end of said discharge vent piping, an outlet filter box.

12. The environmental enclosure as set forth in claim 11, wherein said outlet filter box comprises a high efficiency filter suitable for capture of noxious gases and particulates, so that filtered air is dischargeable into an interior space.

13. The environmental enclosure as set forth in claim 1, wherein said enclosure comprises an interior containment portion, and wherein said enclosure is characterized in that said enclosure has an open bottom suitable for placement on a pre-selected substrate, and wherein no barrier is provided between said pre-selected substrate and the interior containment portion of said enclosure.

14. The environmental enclosure as set forth in claim 13, wherein said opposing side-wall panels of said enclosure are generally trapezoidal in shape.

15. The environmental enclosure as set forth in claim 1, wherein said optically reliable top comprises acrylic plastic.

16. The environmental enclosure as set forth in claim 1, wherein said optically reliable top comprises Plexiglas® brand acrylic.

17. The environmental enclosure as set forth in claim 1, wherein each of said opposing side-wall portions further comprise a sidewall cutout edge wall, said cutout edge wall defining an air outlet opening.

18. The environmental enclosure as set forth in claim 17, further comprising at least one air outlet cover plate affixed to one of said opposing side-wall portions, and wherein at least one of said air outlet openings is fluidly sealed by said cover plate.

19. The environmental enclosure as set forth in claim 1, wherein only one of said opposing side-wall portions further comprise a sidewall cutout edge wall, said cutout edge wall defining an air outlet opening.

20. The environmental enclosure as set forth in claim 19, further comprising an air outlet tube portion, wherein said air outlet tube portion is securely affixed to said air outlet opening, and wherein said air outlet tube is adapted to receive therethrough an outlet air stream.

* * * * *